US005217223A

United States Patent [19]

Feeney

[11] Patent Number: 5,217,223

[45] Date of Patent: Jun. 8, 1993

[54] TENNIS RACKET WITH METAL/COMPOSITE FRAME

[75] Inventor: Brian P. Feeney, Enfield, Conn.

[73] Assignee: Lisco, Inc., Tampa, Fla.

[21] Appl. No.: 728,391

[22] Filed: Jul. 11, 1991

[51] Int. Cl.[5] ..... A63B 49/12

[52] U.S. Cl. ..... 273/73 C; 273/73 G; 273/73 H; 273/73 K

[58] Field of Search ..... 273/73 R, 73 C, 73 D, 273/73 E, 73 F, 73 G, 73 H, 73 J, 73 K

[56] References Cited

U.S. PATENT DOCUMENTS

| | | | |
|---|---|---|---|
| 1,532,991 | 4/1925 | De Meza | 273/73 G |
| 2,783,173 | 2/1957 | Walker et al. | 273/73 K X |
| 3,814,423 | 6/1974 | Shockley et al. | 273/73 G |
| 3,899,172 | 8/1975 | Vaughn et al. | 273/73 H X |
| 4,023,799 | 5/1977 | Van Auken | 273/73 F |
| 4,066,260 | 1/1978 | Rodgers, Jr. | 273/73 H X |
| 4,114,880 | 9/1978 | Cecka | 273/73 G |
| 4,119,313 | 10/1978 | Popplewell et al. | 273/73 K |
| 4,394,015 | 7/1983 | Bosnia | 273/73 K X |
| 4,423,869 | 1/1984 | Haines | 273/73 K X |

FOREIGN PATENT DOCUMENTS

| | | | |
|---|---|---|---|
| 0162109 | 11/1954 | Australia | 273/73 K |
| 0210557 | 3/1956 | Australia | 273/73 G |
| 1168573 | 9/1958 | France | 273/73 K |
| 0616849 | 4/1980 | Switzerland | 273/73 G |
| 616849A5 | 4/1980 | Switzerland | 273/73 G |
| 45495 | of 0000 | Taiwan . | |
| 0858169 | 1/1961 | United Kingdom | 273/73 G |
| 2089219 | 6/1982 | United Kingdom | 273/73 G |

OTHER PUBLICATIONS

"Durafiber", *Hill's Court Inc. Catalog* Fall-Christmas 1976, Sep. 1976, p. 30.

"Racket Blends Glass, Aluminum", *The Sporting Goods Dealer,* Oct. 1973, p. 164.

"Aluminum Racket Built for Women", *The Sporting Goods Dealer,* Jun. 1976, p. 131.

*Primary Examiner*—William H. Grieb
*Assistant Examiner*—William E. Stoll

[57] ABSTRACT

A racket frame comprising a tube shaped into a handle, a head and intermediate beams therebetween; a yoke coupled to the portion of the head adjacent to the beams to thereby form a string-receiving opening; and linearly aligned fibers in an elastomeric matrix binder around the tube and yoke to both strengthen and couple the tube and yoke. Also disclosed are methods of manufacture.

12 Claims, 5 Drawing Sheets

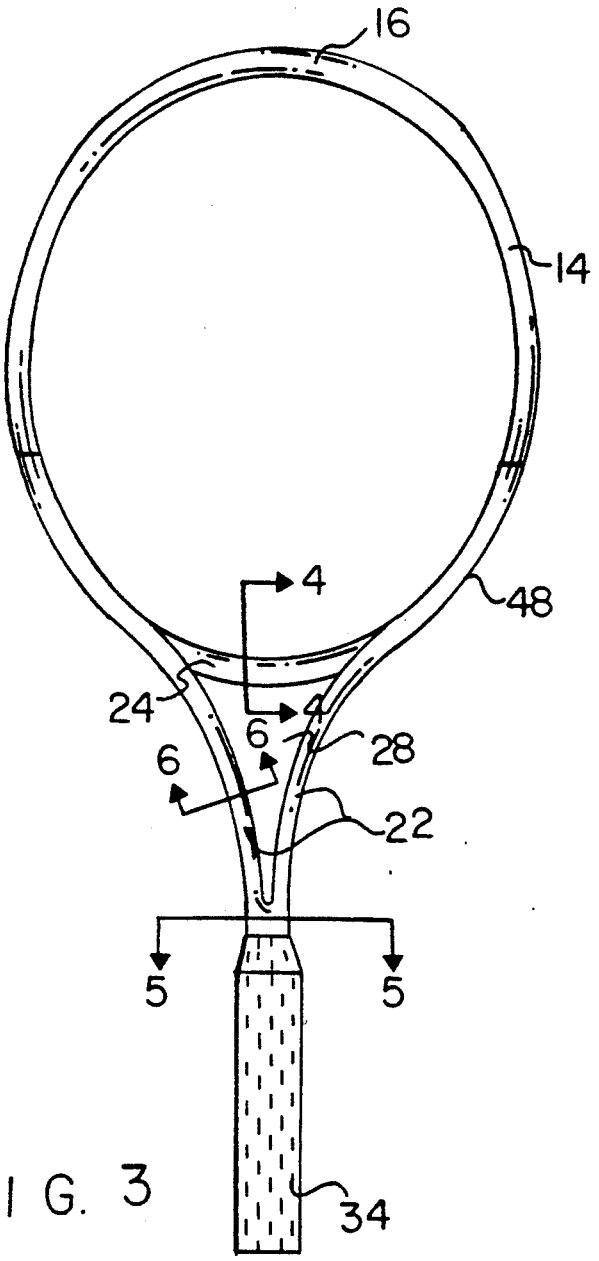
FIG. 3
FIG. 4
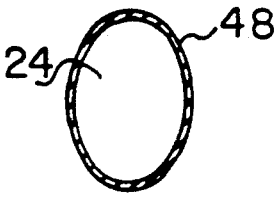
FIG. 5
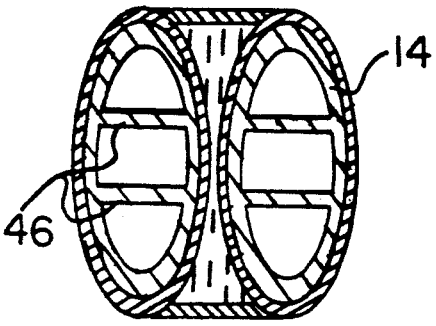
FIG. 6
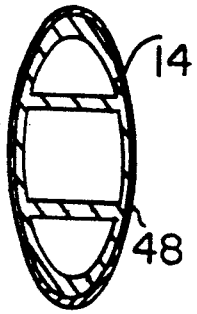

TENNIS RACKET WITH METAL/COMPOSITE FRAME

BACKGROUND OF THE INVENTION

Field of the Invention

This invention relates to a tennis racket with a metal/composite frame and, more particularly, to a tennis racket having a frame formed of an aluminum core and an exterior composite layer.

Description of the Background Art

In tennis, players use rackets to strike a resilient ball across a net. The racket is constructed of a frame having a handle portion gripped by the player, and having a looped head portion with crossed strings for striking the ball, and having an intermediate portion with beams and a throat piece coupling the handle and the head.

Tennis racket frames have been traditionally constructed of a large number of materials. Originally they were constructed of wood. Subsequently, metal rackets were utilized to a great extent. More recently, racket frames of composite materials have become popular since they decrease weight and improve playability features in terms of increased stiffness and lower vibration. Composite rackets, however, are expensive, particularly due to more complex fabrication techniques and use of expensive reinforcing fibers such as graphite, aramid, or fiberglass fibers, or the like.

With regard to metal rackets, a large number of metals have been utilized over time. One such metal is aluminum characterized by its relatively inexpensive cost. Metal rackets, however, are not perceived as performing as well as composite rackets particular in terms of vibration abatement. Much of the perception can be attributed to the looks of the racket, notably the discontinuity of the frame, yoke piece and top cap.

A review of commercial devices and the patent literature illustrates various techniques for constructing tennis racket frames of aluminum in a manner so as to improve its playing characteristics. One area wherein the prior art has been deficient is in the throat piece, that material at the bottom of the head for coupling adjacent parts of the frame to complete the oval head.

Coupling between the throat piece and the adjacent frame portion has traditionally been done by welding, riveting or bolting less than desirable techniques from the standpoint of both structural integrity and appearance. Aluminum as well as plastic throat pieces have also been employed on metal rackets including aluminum. Again, such throat pieces are characterized by minimized playing characteristics and less than desirable appearance. One advantage of aluminum over composite rackets comes in terms of durability. Whereas composite rackets are somewhat susceptible to impact failure due to either abuse or even under normal playing conditions, aluminum rackets are known to be both durable and economical. Minor cracks in composite rackets lend to replacement of the entire racket whereas a minor dent in an aluminum frame should not affect the performance of the racket.

As illustrated by a great number of patents as well as commercial rackets, efforts are continuously being made in an attempt to improve tennis rackets. Such efforts are made to render tennis rackets of ever increasing capabilities during play. None of these previous efforts, however, provides the benefits attendant with the present invention. Additionally, the prior patents and commercial devices do not suggest the present inventive combination of method steps and component elements arranged and configured as disclosed and claimed herein. The present invention achieves its intended purposes, objects and advantages through a new, useful and unobvious combination of method steps and component elements, with the use of a minimum number of functioning parts, at a reasonable cost to manufacture and by employing only readily available materials.

Therefore, it is an object of the present invention to provide an improved tennis racket frame comprising a tube shaped into a handle, a head and intermediate beams therebetween; a yoke coupled to the portion of the head adjacent to the beams to thereby form a string-receiving opening; and linearly aligned fibers in an elastomeric matrix binder around the tube and yoke to both strengthen and couple the tube and yoke.

It is a further object of the invention to manufacture improved metal/composite racket frames.

It is a further object of the present invention to improve the playing characteristics of aluminum tennis racket frames by covering the exterior surface with composite material.

It is a further object of the present invention to strengthen the throats and critical regions of aluminum tennis rackets by the utilization of layers of composite material.

It is a further object of the present invention to cover aluminum tennis rackets with composite material for improving strength and playing characteristics, notably decreasing the vibration of the racket.

It is a further object of the present invention to impart the appearance and playability of graphite rackets to aluminum rackets.

It is a further object of the present invention to securely couple a throat piece to the frame portion of an aluminum tennis racket.

It is a further object of the present invention to mold a composite layer to portions of a tennis racket frame through molding techniques which employ a viscoelastic material for providing the necessary bond pressure between the composite layers and the aluminum.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the attached claims with the specific embodiments shown in the attached drawings. For the purpose of summarizing this invention, the invention may be incorporated into a racket frame comprising a tube shaped into a handle, a head and intermediate beams therebetween; a yoke coupled to the portion of the head adjacent to the beams to thereby form a string-receiving opening; and linearly aligned fibers in an elastomeric matrix binder around the tube and yoke to both strengthen and couple the tube and yoke. Also disclosed are method of manufacture.

The tube is of a generally oval configuration and formed of aluminum. The yoke is plastic with a solid cross-sectional configuration. The fibers and binder may form a tape which is wrapped around the tube and yoke. The tape is wrapped with the fibers at an angle of between about 30 and 45 degrees from the axis of the tube and yoke. Two tapes are wrapped around the tube, one over the other, with their fibers disposed at equal but opposite angles. Four tapes are wrapped around the tube, one over the other, with their fibers disposed at equal but opposite angles. The fibers may be braided and the matrix is of a tubular configuration. The fiber material is selected from the class of flexible, inextensible materials which includes carbon, boron and fiberglass. The matrix material is selected from the class of setable plastic materials which includes epoxy, vinyl ester, polyester and polyurethane. The fibers and binder may separately cover the tube and yoke with additional fibers and binder extending from the yoke to the tube to strengthen the coupling therebetween.

The invention may also be incorporated into a game racket comprising a frame formed of an aluminum tube with a generally oval configuration shaped into a handle and a head and intermediate beams therebetween, a plastic yoke with a solid cross-sectional configuration coupled to the portion of the head adjacent to the beams to thereby form a string-receiving opening, and linearly aligned carbon fibers in an epoxy binder forming a tape which is wrapped one over the other around the yoke and at least that portion of the tube from the lower portion of the head to the upper portion of the handle with the fibers at equal and opposite angles of between about 30 and 45 degrees from the axis of the tube and yoke to both strengthen and couple the tube and yoke and with additional tape extending from the yoke to the tube to strengthen the coupling therebetween and with a plastic insert between the tube sections at the upper end of the handle; strings supported by the frame in the string-receiving opening; and a pallet and grip overlying the handle.

The invention may also include a method of fabricating a tennis racket frame formed of an aluminum tube with a generally oval configuration shaped into a handle and a head and intermediate beams therebetween, a plastic yoke with a solid cross-sectional configuration coupled to the portion of the head adjacent to the beams to thereby form a string-receiving opening, and linearly aligned fibers in a matrix binder forming a material which is wrapped around the tube and yoke one over the other with the fibers at equal and opposite angles of between about 30 and 45 degrees from the axis of the tube and yoke to both strengthen and couple the tube and yoke and with additional tape extending from the yoke to the tube to strengthen the coupling therebetween, the method comprising the steps of:

extruding a tubular core of aluminum; molding a yoke of plastic material;

overlaying a plurality of layers of linearly aligned fibers in a resin binder around at least a portion of the metal core;

overlaying a plurality of layers of linearly aligned fibers in a resin binder around the yoke; shaping the core to its intended configuration;

positioning the yoke in its intended position with respect to the core;

placing the layered core and yoke in a mold;

providing viscoelastic material between at least a portion of the layers and the mold; and applying heat and pressure through the mold to bond the layers to the core and to expand the viscoelastic material to increase the pressure between the core and layers for improving the bond therebetween.

The fibers and the binder may form a tape and the overlaying steps are effected by wrapping the tape over the core and the yoke. The fibers and the binder may form a tubular sleeve and the overlaying steps are effected by sliding the sleeve over the core and the yoke. The provided viscoelastic material may extend from the lower extent of the head to the upper extent of the handle. The viscoelastic material may be formed as strips positioned in mold recesses on opposite sides of the beams. The provided viscoelastic material may extend over the entire extent of the core. The method further includes positioning a plastic insert between the core portions at the upper end of the handle.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other methods and structures for carrying out the same purposes of the present invention. It should also be realized by those skilled in the art that such equivalent methods and structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 3 is a plan view of the frame similar to FIG. 2 but with the pallet added.

FIGS. 4, 5 and 6 are sectional views taken through FIG. 3 along lines 4—4, 5—5 and 6—6.

Similar reference characters refer to similar parts throughout the several views of the drawings.

DETAILED DESCRIPTION OF THE PREFERRED EMBODIMENT

Figure 1:
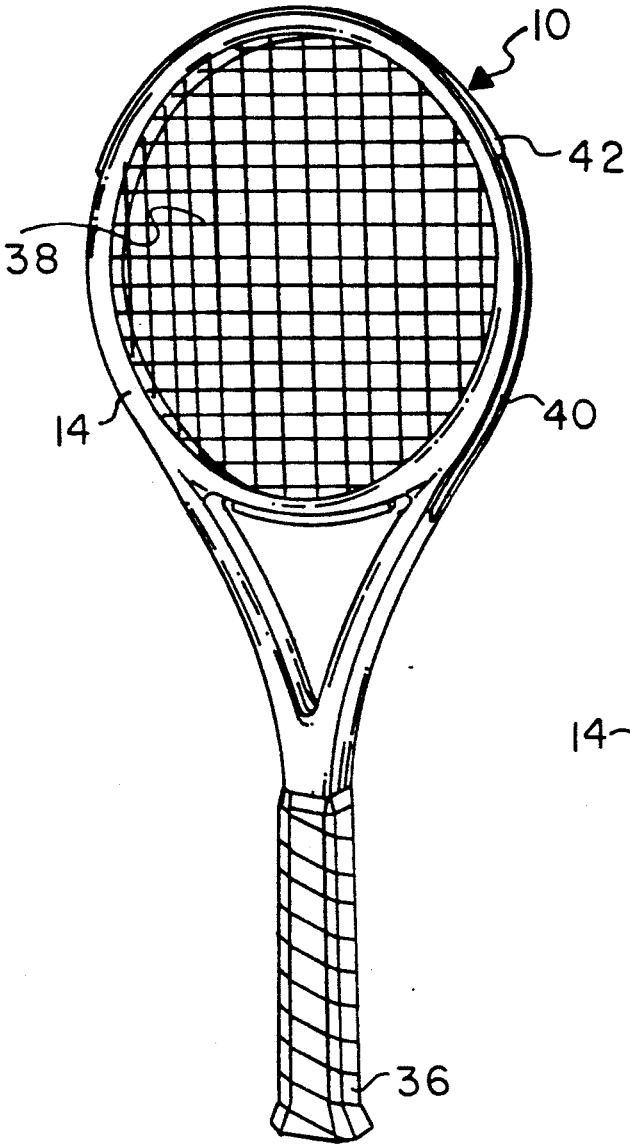
FIG. 1 is a tennis racket with a frame constructed in accordance with the principles of the present invention.
Figure 2:
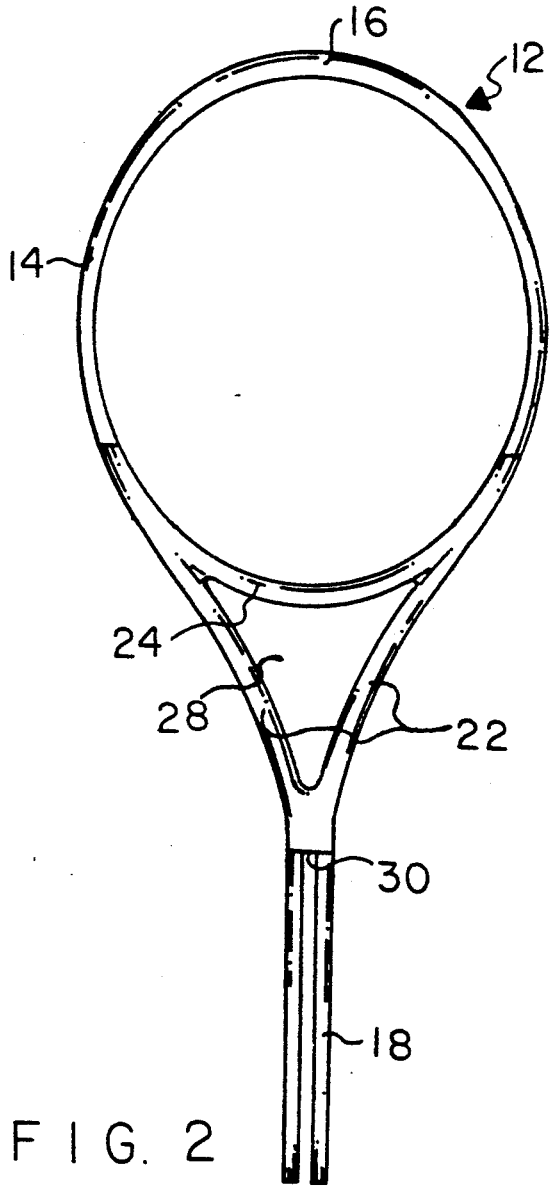
FIG. 2 is a plan view illustrating the tennis racket frame of FIG. 1.

With particular reference to the Figures, there is shown in FIG. 1 a perspective illustration of a tennis racket 10 constructed in accordance with the principles of the present invention. The major component of the tennis racket 10 is the frame 12. The frame 12 by itself is shown in FIG. 2, a plan view. The frame is constructed of conventional metal preferably aluminum in a tubular configuration with an exterior of graphite fiber impregnated with an epoxy resin. The core 14 is of a hollow tubular construction shaped in an oval configuration at the head 16 or head end and with the tube in parallel, side-by-side relationship at the handle 18 or handle end. Therebetween, the frame has an intermediate portion or beams 22 coupling the head 16 and the handle 18. A throat piece or yoke 24 closes the head oval at its lower end at the beams 22. The yoke 24 is coupled to the remainder of the frame during the bonding/molding process and thereby becomes an essentially integral component of the frame 12 and racket 10. The beams 22 and yoke 24 form an open throat 28. The area at the top of the handle is also joined together with a plastic insert 30 during the bonding/molding process thus providing a finished frame without any visible seams and which is virtually indistinguishable from a completely composite racket. The joining of the yoke with the head and the beams is by cohesion, an intermingling of common components including resin matrix and fibers of the cohered materials.

The other principle component of the racket the strings 38 which are essentially interwoven through holes in the frame along parallel lines. Main or vertical strings extend parallel with the central axis of the frame and racket. Minor or cross horizontal strings are strung in the head perpendicular to the central axis in an axis and are interwoven through the vertical strings. Together the strings lie in a plane and constitute the striking surface for hitting the ball during play. The strings extend through small holes or apertures around the entire periphery of the head including the yoke which can be considered as an integral extension of the lower portion of the head. The main strings are formed from a common first string extending through vertically aligned holes while the minor strings are formed from a common second string extending through horizontally aligned holes.

Another component of the racket is the handle. The handle is fabricated of a pallet 34 or underlisting on the frame made of a hard or soft polyurethane which is then covered by spirally wrapping leather or synthetic grip 36 thereover. Weights, as of lead, may be added to the handle portion of the frame beneath the pallet for balancing purposes. Such components are conventional in the tennis art.

The head end of the frame may be provided with a grommet strip 40 and/or bumper strip 42. The grommet strip 40 is a moldable, hard, synthetic material such as nylon on the radial exterior of the head with barrels extending through the head holes through which the strings pass. The bumper strip 42 is also of a similar material and extends radially exterior of the head at its upper extent. It extends axially a greater distance than the grommet strip to preclude scraping the frame. Such components are conventional in the tennis art.

Greater details of construction can be seen in FIGS. 4,5 and 6. Sections taken through lines 4—4, 5—5 and 6—6 of FIG. 2. By way of example, section 4—4 illustrates a section of the racket frame taken through the yoke 24, FIG. 5 illustrates a section 5—5 through the handle of the racket, and FIG. 6 illustrates a section 6—6 through one of the throat beams 22. The core 14 includes an extruded tubular piece of aluminum having an oval cross section with two interior cross pieces 46 extruded therewith to add strength to the section. Surrounding the frame are two layers of tape 48 of an epoxy matrix 50 with graphite fibers 52 oriented preferably between 30 and 45 degrees from the axis of the tube. Suitable materials for the binder include epoxy, vinyl ester, polyester, polyurethane, etc. Suitable materials for the fibers include carbon, boron, fiberglass, etc.

FIG. 4 is an cross sectional illustration through the yoke or throat piece 24. As can be seen the throat piece is basically of a solid expandable hard foam such as a thermoplastic matrix with reinforcing fiberglass, carbon, nylon, etc. It is molded in a proper orientation prior to coupling with the frame and molding therewith. Surrounding the foam throat piece are a plurality of layers of tape 48 graphite/epoxy for strength and for bonding with the similar graphite/epoxy around the frame at the bottom of the head. Although two layers of tape are used over the majority of the frame portions being strengthened, preferably a greater number of layers as for example of such graphite for epoxy tape are utilized around the plastic throat piece. The plastic throat piece 24 is configured for fitting tightly in the space at the bottom of the head. Additional tails 56 of graphite/epoxy tape 48 extend from the molded throat piece for contact with the graphite epoxy tape of the aluminum frame in the area of contact for increasing and strengthening the bond therebetween.

FIG. 5 is an illustration taken through the handle portion of the frame illustrating two parallel tubes wrapped with the two layers of graphite epoxy spaced a short distance with a piece of solid expandable foam 30 therebetween. Suitable materials for such solid expandable foam include a thermoplastic matrix with reinforcing fibers of fiberglass, carbon, nylon etc.

The expandable foam insert piece 30 is adapted upon molding to securely couple with the graphite layer around the aluminum extrusion for securing the tubular portions of the handle in a strong bonded relationship. Such expandable foam is located merely in the upper end of the handle area immediately beneath the area of joining between the beams.

Figure 10:
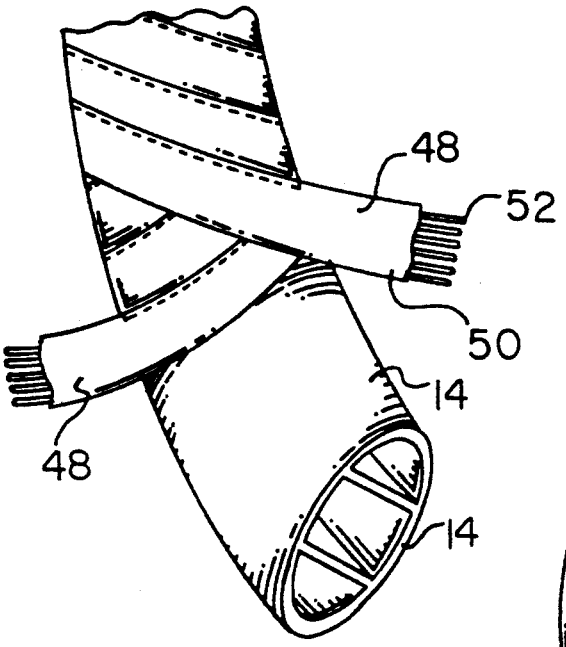
FIGS. 10 and 11 are perspective illustrations of the frame portions illustrating the tape and sleeve coverings.

FIG. 10 is an illustration of the two wrapped layers of tap 48 around the aluminum frame portion 14 with the layers of tape 48 partially removed to show the constructions thereof.

Figure 11:
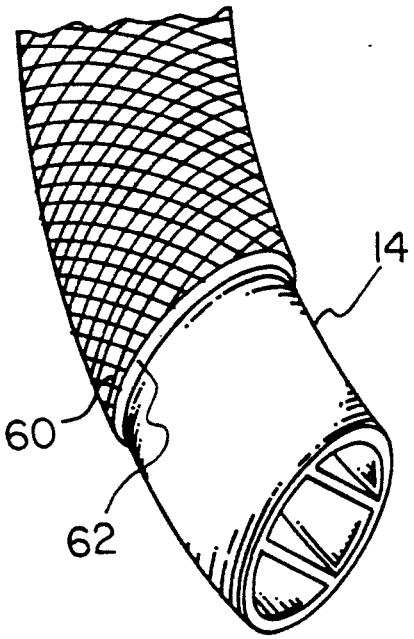

FIG. 11 is an illustration similar to FIG. 6 but illustrates the graphite fibers 60 being applied to the aluminum frame 14 through a braided tube or sleeve 62 rather than through the wrapped tape as described hereinabove. In such configuration, the plurality of strands in the matrix of the tube are again preferably at an angle 30 to 45 degrees from the axis as in the primary embodiment.

Figure 7:
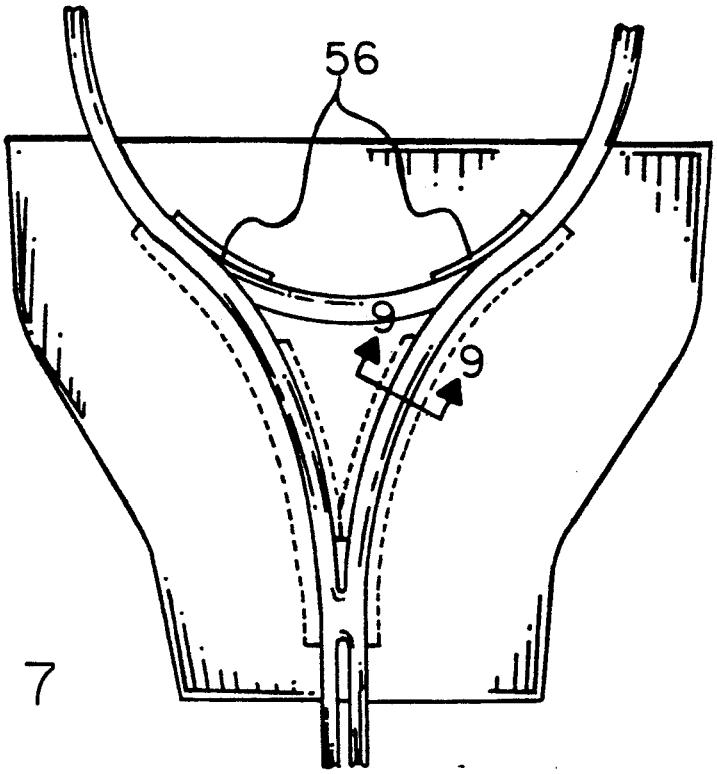
FIG. 7 is a plan view of a portion of the frame of FIG. 3 in the mold.
Figure 8:
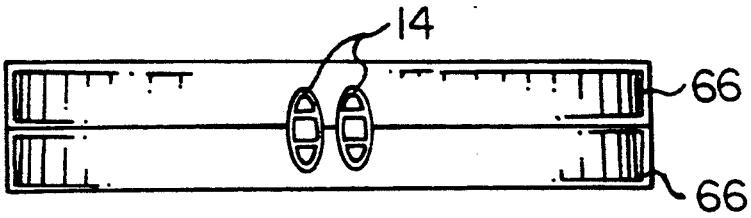
FIG. 8 is an end view of FIG. 7.
Figure 9:
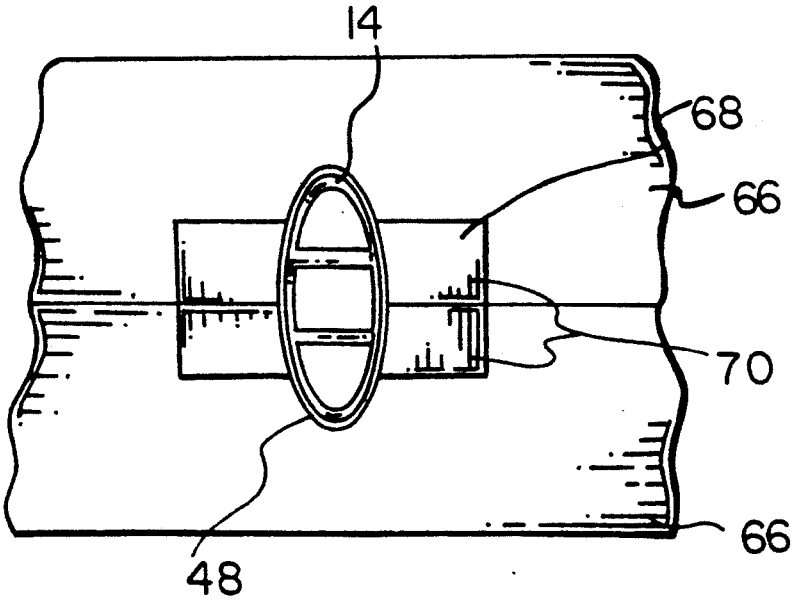
FIG. 9 is a sectional view taken through line 9—9 of FIG. 7.

In accordance with the method of fabrication, the aluminum tubing is covered with layers of graphite pre-preg in the tape 48 or sleeve 62 form. Matched die halves 66 of a compression molding device provide the necessary pressure for bonding of composite to the aluminum on the top and bottom edges. The method further involves the use of a viscoelastic material 68, as for example silicone, or the like, with a high thermal coefficient of expansion to provide the bonding pressure on the sides of the tubing. The expanding foam forms the yoke and handle filling sections. The idea is to make a two piece matched mold of any metal. The mold will have the necessary opening for the aluminum tube wrapped with a composite pre-preg. As shown in FIG. 9, the sides of the matched mold will be machined out to form recesses 70 and viscoelastic inserts 68 formed to take the place of the metal in this area. The aluminum/-composite frame will be placed inside the mold, the mold halves closed, and the entire structure heated. Note FIGS. 7, 8 and 9. Under heat the elastomer tends to expand, but because it is completely enclosed the pressure builds. This pressure is used to bond the composite material to the aluminum. It is preferred that the exterior surface of the aluminum be roughened to enhance such bonding.

Figure 12:
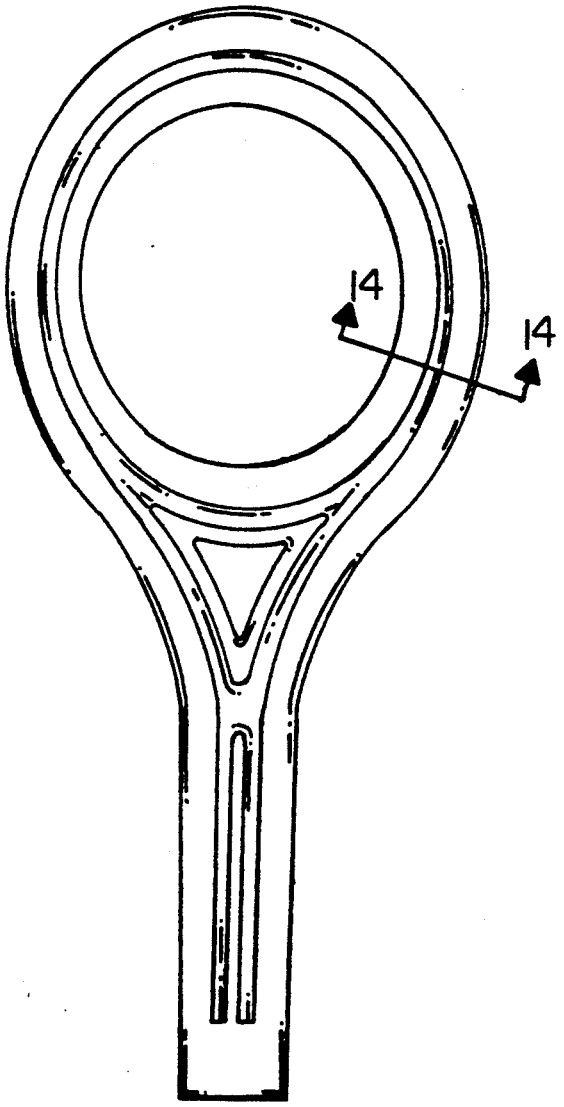
FIG. 12 is a plan view of an alternate embodiment of the racket in an alternate embodiment of the mold.
Figure 13:
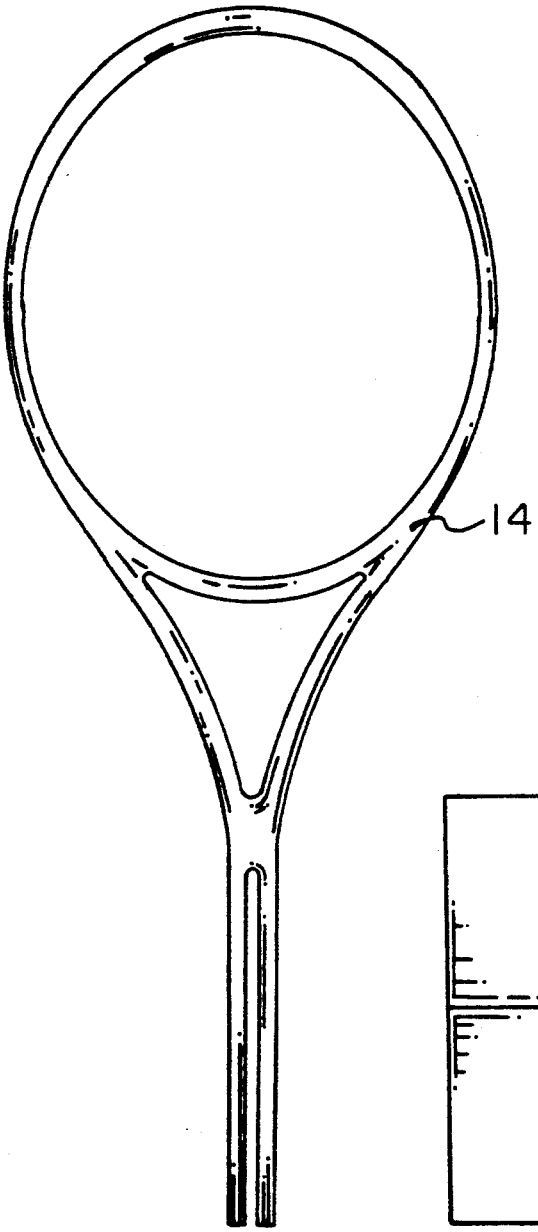
FIG. 13 is a plan view of the frame of FIG. 12.
Figure 14:
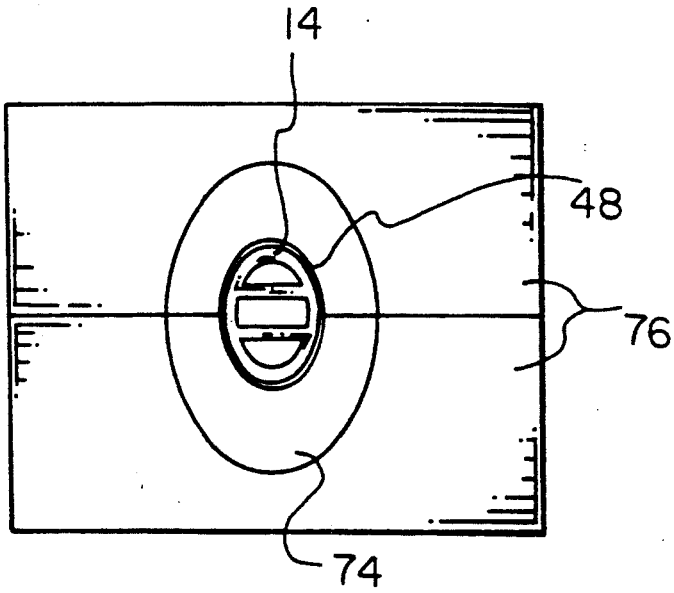
FIG. 14 is a sectional view taken through line 14—14 of FIG. 12.

An alternate method of fabrication is shown in FIGS. 12, 13 and 14. Such molding technique is similar to that employed in the method described above with respect to FIGS. 7, 8 and 9. In this alternate method, the entire tubular member, aluminum frame 14 as well as throat piece 24, are separately covered entirely with a prepreg resin tape 42 or sleeve 62. All of the wrapped pieces are then wrapped with a strip or strips of viscoelastic material 74 such as silicone or the like. This additional layer has an additional ¼ inch or so to the thickness of the frame components. The entire doubly wrapped aluminum frame core is then placed into a metal mold 76. The entire mold is enlarged for the receipt of the aluminum core wrapped with the prepreg tape and silicone overlayer. Thereupon with the application of heat and pressure from the mold, consolidation occurs between the aluminum of the core and the prepreg tape therearound. Such pressure is increased through the expansion of the viscoelastic silicone layer as it expands through the application of heat. In this manner, the entire racket is provided with a strengthening bond. In comparison to this, the prior embodiment in FIGS. 7, 8 and 9 only applies such silicone pressure to the sides of the aluminum tubing.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of structures and the combination and arrangement of parts may be resorted to without departing from the spirit and scope of the invention.

Now that the invention has been described,

What is claimed is:

1. A racket frame comprising:

a hollow aluminum tube with an essentially common cross section along its entire length and shaped into a handle, a head and intermediate beams therebetween;

a solid synthetic yoke with an exterior cross section essentially the same as that of the tube coupled to the portion of the head adjacent to the beams to thereby form an oval string-receiving opening; and a plurality of overlying linear strips, each strip having unidirectional fibers in a polymeric matrix binder, the strips being located around the tube and yoke to strengthen the tube and yoke and to form an interface between the aluminum tube and the solid synthetic yoke.

2. The frame as set forth in claim 1 wherein the tube is of a generally oval configuration and formed of aluminum.

3. The frame as set forth in claim 1 wherein the yoke is plastic with a solid cross-sectional configuration.

4. The frame as set forth in claim 1 wherein the fibers and binder form a tape which is wrapped around the tube and yoke.

5. The frame as set forth in claim 4 wherein the tape is wrapped with the fibers at an angle of between about 30 and 45 degrees from the axis of the tube and yoke.

6. The frame as set forth in claim 5 wherein two tapes are wrapped around the tube, one over the other, with their fibers disposed at equal but opposite angles.

7. The frame as set forth in claim 5 wherein four tapes are wrapped around tube, one over the other, with their fibers disposed at but opposite angles.

8. The frame as set forth in claim 4 wherein the fibers are braided and the is of a tubular configuration.

9. The frame as set forth in claim 1 wherein the fiber material is selected from the class of flexible, inextensible materials which consisting of carbon, boron and fiberglass.

10. The frame as set forth in claim 1 wherein the matrix material is selected from the class of setable plastic materials which includes epoxy, vinyl ester, polyester and polyurethane.

11. The frame as set forth in claim 1 wherein the fibers and binder separately cover the tube and yoke with additional fibers and binder extending from the yoke to the tube to strengthen the coupling therebetween.

12. A game racket comprising:

a frame formed of an aluminum tube with a generally common oval configuration along its entire length shaped into a handle and a head and intermediate beams therebetween, a solid synthetic yoke coupled to the portion of the head adjacent to the beams to thereby form a string-receiving opening, and linearly aligned carbon fibers in an epoxy binder forming tapes which are wrapped one over the other around the yoke and at least that portion of the tube from the lower portion of the head to the upper portion of the handle with the fibers at equal and opposite angles of between about 30 and 45 degrees from the axis of the tube and yoke to both strengthen and couple the tube and yoke and to form a tape interface between the aluminum tube and the solid plastic yoke and with additional tape extending from the yoke to the tube to strengthen the coupling therebetween and with a solid synthetic insert between the tube sections at the upper end of the handle;

strings supported by the frame in the string-receiving opening; and a pallet and grip overlying the handle.

* * * * *